United States Patent [19]

Rowlands et al.

[11] Patent Number: 4,765,039

[45] Date of Patent: Aug. 23, 1988

[54] MAT HOLDER

[75] Inventors: Martyn Rowlands; John Calvert, both of Epping, Great Britain

[73] Assignee: Kimberly-Clark Limited, Latkfield near Maidstone, England

[21] Appl. No.: 94,949

[22] Filed: Sep. 9, 1987

[30] Foreign Application Priority Data

Sep. 11, 1986 [GB] United Kingdom ..... 8621916

[51] Int. Cl.[4] ..... A47G 27/02

[52] U.S. Cl. ..... 24/556; 24/461; 160/380; 52/222

[58] Field of Search ..... 24/556, 557, 542, 326, 24/113 MP, 460, 462, 461; 160/386, 392, 398; 52/222

[56] References Cited

U.S. PATENT DOCUMENTS

| | | | |
|---|---|---|---|
| 2,343,037 | 2/1944 | Adelman | 160/380 |
| 3,220,469 | 11/1965 | Oehmig | 160/380 |
| 3,729,045 | 4/1973 | MacDonald | 160/380 |
| 4,193,235 | 3/1980 | Cucchiara | 52/222 |
| 4,549,334 | 10/1985 | Miller | 160/398 |
| 4,566,236 | 1/1986 | Pound | 160/380 |

FOREIGN PATENT DOCUMENTS 2168894 7/1986 United Kingdom .

*Primary Examiner*—Victor N. Sakran

*Attorney, Agent, or Firm*—William D. Herrick

[57] ABSTRACT

A holder for flexible material comprising a flat base on which the material rests and at least one hinged side flap adapted to fold over on top of an edge of the material to hold the material in positon, characterized in that beneath the/or each hinged flap an upstanding wall extends from the base to form a backstop and a corresponding flange descends downwardly from the flap adjacent the hinge, the flange and wall being so arranged and dimensioned that when the flange is opened by upward hinged movement from the base ready to receive an edge portion of material, the bottom edge of the flange rests on the upper free edge of the wall to keep the flap open, on closure of the flap the bottom surface of the flange being arranged to 'cam' over the upper surface of the wall, the wall, flange and/or hinge resiliently moving until the flange is free of the wall to close down over material positioned on the base. Thus the material can rapidly be inserted into the holder in the correct position and firmly held in the holder by simple closure of the flap.

4 Claims, 2 Drawing Sheets

MAT HOLDER

This invention relates to holders for flexible material and particularly to holders for disposable floor mats. It is desirable for such holders to close over the edges of a disposable mat which is normally relatively thin as compared with a conventional bristle mat so as to maintain it in a taut position for use. On the other hand it is desirable fairly readily to be able to open the holder so that the disposable mat may be removed and a fresh mat inserted.

One suitable holder is described and claimed in published application U.S. Pat. That holder comprises a flat base adapted to hold the mat and at least one hingably connected side flap adapted to fold over on top of the edge of a mat and securely maintain the mat in position. Means are included to hold the flap against the mat in a closed position to prevent the mat bunching, wrinkling, or slipping.

Such a holder in accordance with this invention has, beneath the/or each hinged flap, an upstanding wall extending from the base to form a backstop and, descending downwardly from the flap adjacent the hinge, a corresponding flange, the flange and wall being so arranged and dimensioned when the flap is opened by upward hinged movement from the base ready to receive the edge portion of a mat, to be held, the bottom edge of the flange rests on the upper free edge of the wall to keep the flap open. The mat material may then be introduced up against the backstop, the flap being then closable over the edge of the mat with the bottom surface of the flange camming over the upper surface of the wall, the wall, flange and/or hinge giving slightly, until the flange is free of the wall to permit the flap to close down over the mat material.

In accordance with a further feature of the invention the hinge between the flap and base edge member and/or the nose of the base edge member, over which the mat material is positioned and past which the edge of the flap moves, is made of softer material than the remainder of the edge member of the holder. For example if the moulded edge member is made of relatively unplasticised polyvinyl chloride the hinge and/or nose of the base member may be made of softer plasticised polyvinyl chloride giving resilience to the members and enabling the mat more firmly to be gripped against the nose.

Preferably the two different grades of plastic material are extruded together during formation of the edge moulding by a co-extrusion process.

Figure 1:
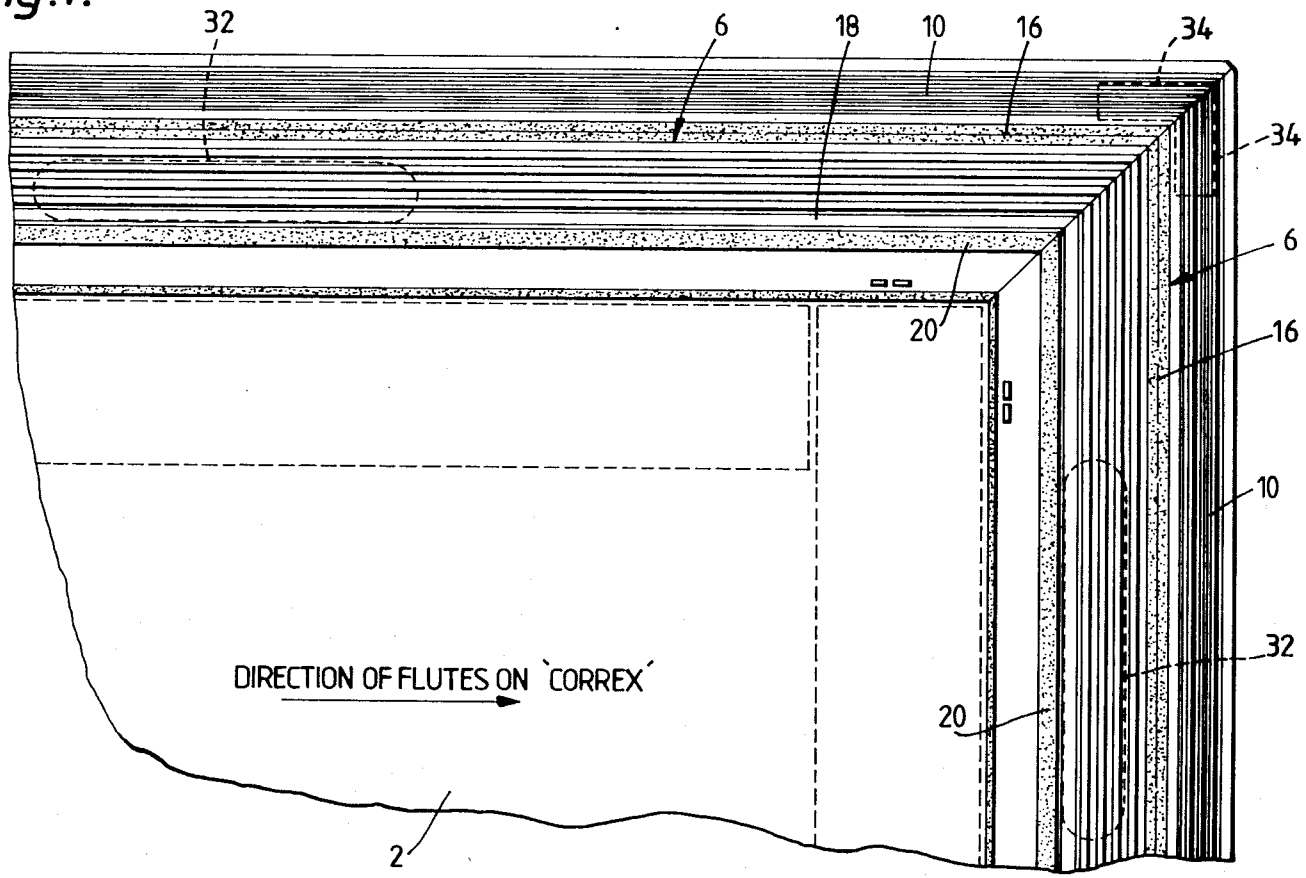
Figure 2:
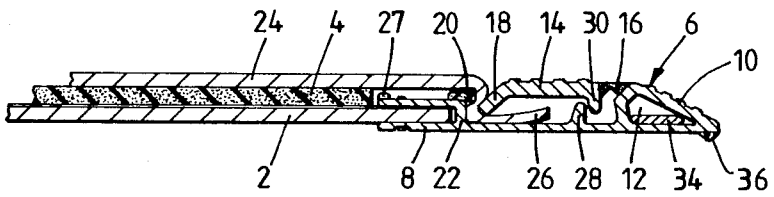
Figure 3:
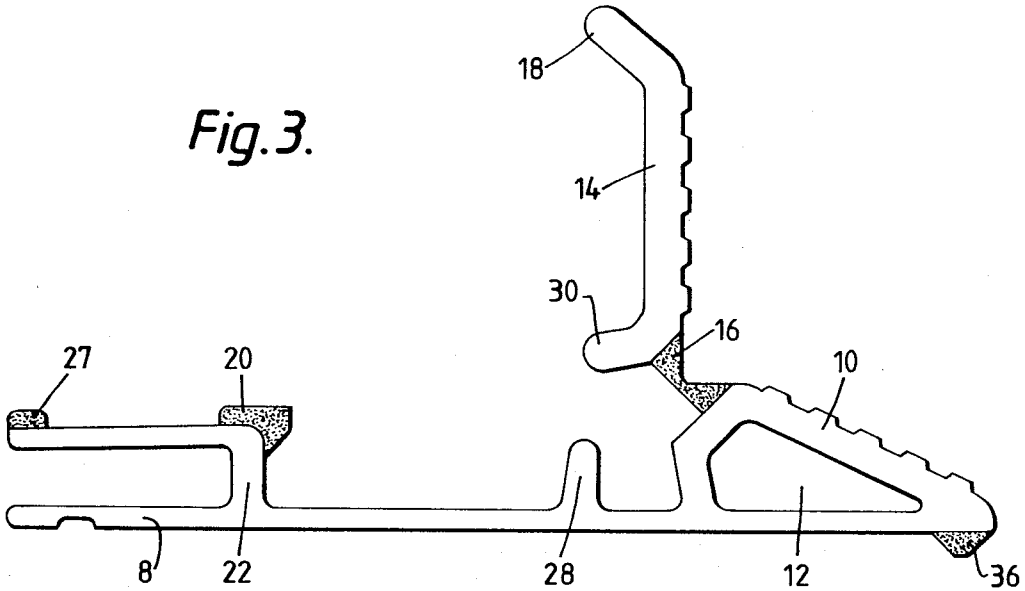

The invention will now be further described by way of example with reference to the accompanying drawings in which:

FIG. 1 is a plan view of a corner of one example of a mat holder with the mat removed, FIG. 2 is a section through the holder with the mat in place and secured in the holder, and FIG. 3 is a detailed view to an enlarged scale of the edge moulding of the holder showing the hinged flap in an open position.

Referring to FIG. 1 the holder comprises a rectangular base 2 of a light but rigid base material preferably in the form of a corrugated board for example the polypropylene material known as Correx made by Corruplast of Bristol Road, Gloucester, Great Britain. A sheet of nonabsorbent closed cellular foamed material 4 (see Fig. 2) overlies the rigid base to provide resilience.

The base 2 is surrounded on all four sides by an edge moulding generally indicated at 6 and which is shown in detail in FIG. 3. This is made of rigid unplasticised polyvinyl chloride and has along its inner edge a socket 8 to receive the edge of the base 2 which is secured therein. The outer side of the edge moulding is formed with an upstanding sloping wall 10 forming a hollow recess 12 to provide strength and means of locating corner fixing pieces.

A flap 14 is hingably connected to the top of the wall 10 by means of a resilient hinge 16 which is formed of flexible plasticised polyvinyl chloride which is co-extruded with the rigid unplasticised pvc.

The hinged flap 14 has a downwardly extending nose member 18 which passes closely adjacent to a nose 20 formed of flexible plasticised pvc and which is located on the corner 22 of the moulding opposite the nose 18. When a mat such as that illustrated at 24 is to be secured in the holder it overlies the base member 4 and its free edge passes over the nose 20. The flap 14 is then closed down onto the material which is resiliently squeezed between the outer edge of the nose member 18 and the flexible nose 20, the nose member 18 passing resiliently beneath the corner 22, both the member 20 and the hinge 16 giving resiliently so as to permit the nose 18 to snap past the corner so that the free edge 26 of the mat is securely held within the edge moulding as shown in FIG. 2.

This happens on all four sides of the mat holder so that the mat is held taut in position.

The soft nose member 20 and a further co-extruded 'soft' ridge 27 over which the mat passes, help to hold the mat properly in position without slippage. The ridge 27 also acts as a resilient support to stop the mat wearing along a rigid ridge.

A wall 28 extends upwardly from the base of the moulding to engage a corresponding flange 30 extending downwardly from the flap member 14 adjacent the hinge 16. When the flap is opened from the position shown in FIG. 2 to that shown in FIG. 3 to permit the used mat to be withdrawn, not only the nose 18 passes resiliently past the nose member 20 but also the free bottom edge of the flange 30 passes resiliently past the upper end of the wall 28 these two members and hinge 16 resiliently moving to permit this to happen.

From the position shown in FIG. 3 the flap hinges downwardly under its own weight and due to the resilient force exerted by the hinge 16, to the position in which the bottom edge of the flange 30 rests on top of the wall 28. This not only prevents the flap from closing too soon but also provides a backstop, formed by the inner sides of the wall 28 and flange 30, against which the free edge of a clean mat can butt prior to clamping. When the flap is then hinged downwardly to trap the mat material as illustrated in FIG. 2, firstly the flange 30 snaps over the top of the wall 28 and then subsequently the nose 18 moves resiliently down past the nose member 20 to trap the mat material, the hinge 16 and nose member 20 moving resiliently.

As is described and claimed in the specification of U.S. Patent 4,564,546 the base of the moulding 6 is formed on each side with two slots 32 to enable a user's hands to pass through the slot to press the flap 14 upwardly when it is desired to open the holder and remove a dirty mat. At the corners the edge moulding 6 is reinforced by a corner support member 34 which is inserted into the hollow recess 12 beneath the outer edge wall 10.

If desired the hinge 16, nose 20, ridge 27 and strip 36, may be coloured differently from the remainder of the edge moulding so as to provide a safety indicator of the presence of a mat.

Strips 36 of relatively soft plasticised pvc extend along the outer edges of the edge moulding and are extruded coincidentally with the remainder of the edge member extrusion. The strips 36 may provide some support but they also function as a grip on the surface on which the holder is laid which could be carpet, concrete or tiles etc.

What we claim is:

1. A holder for flexible material comprising a flat base on which the material rests and at least one hinged side flap adapted to fold over on top of an edge of the material to hold the material in position, characterised in that beneath each hinged flap an upstanding wall extends from the base to form a backstop and a corresponding flange descends downwardly from the flap adjacent the hinge, the flange and wall being so arranged and dimensioned that when the flange is opened by upward hinged movement from the base ready to receive an edge portion of material, the bottom edge of the flange rests on the upper free edge of the wall to keep the flap open, on closure of the flap the bottom surface of the flange being arranged to 'cam' over the upper surface of the wall, the wall, flange or hinge resiliently moving until the flange is free of the wall to close down over material positioned on the base squeezing the material between the flap and the base.

2. A holder as claimed in claim 1 in which the hinge between the flap and base member and/or the nose of the base member over which the material may be positioned and past which the edge of the flap moves, is made of softer material than the remainder of the edge member of the holder.

3. A holder as claimed in claim 2 wherein the edge member is made of relatively unplasticised polyvinyl chloride, the hinge and/or nose being made of softer plasticised polyvinyl chloride giving the necessary resilience.

4. A holder as claimed in claim 3 wherein the two different grades of plastic material are extruded simultaneously during formation of the edge member.

* * * * *